US007389774B1

(12) United States Patent
Fonda

(10) Patent No.: US 7,389,774 B1
(45) Date of Patent: Jun. 24, 2008

(54) SLINGSHOT AND ARCHERY TRAINING DEVICE AND ASSOCIATED METHODS

(76) Inventor: Jacob H. Fonda, 11350 Cuckoo Dr., Leesburg, FL (US) 34788

( * ) Notice: Subject to any disclaimer, the term of this patent is extended or adjusted under 35 U.S.C. 154(b) by 157 days.

(21) Appl. No.: 11/179,224

(22) Filed: Jul. 12, 2005

(51) Int. Cl.
*F41B 3/02* (2006.01)

(52) U.S. Cl. ..... 124/20.1

(58) Field of Classification Search ..... 124/20.1, 124/20.3

See application file for complete search history.

(56) References Cited

U.S. PATENT DOCUMENTS

| | | | | |
|---|---|---|---|---|
| 2,715,895 | A | 8/1955 | Loveless | |
| 2,735,417 | A * | 2/1956 | Denekar | 124/20.1 |
| 4,198,949 | A * | 4/1980 | Cook | 124/20.1 |
| 4,722,316 | A | 2/1988 | Stinnett et al. | |
| 4,873,963 | A * | 10/1989 | Lemmen | 124/20.3 |
| 5,016,601 | A | 5/1991 | Ferguson et al. | |
| 5,072,715 | A | 12/1991 | Barr | |
| 5,230,323 | A | 7/1993 | Saunders et al. | |
| 5,431,145 | A | 7/1995 | Strait et al. | |
| 5,501,207 | A * | 3/1996 | Black | 124/20.1 |
| 5,619,978 | A | 4/1997 | Flournoy | |
| 5,694,913 | A | 12/1997 | Parrott | |
| 5,803,067 | A | 9/1998 | Ellenburg et al. | |
| 6,004,233 | A * | 12/1999 | Raubuck et al. | 473/505 |
| 6,564,787 | B1 | 5/2003 | Barry | |
| 6,786,213 | B1 * | 9/2004 | Lee | 124/20.1 |
| 6,823,855 | B2 | 11/2004 | Omi | |

* cited by examiner

*Primary Examiner*—John Ricci

(57) ABSTRACT

A device for projecting objects includes a frame having an aperture therethrough and a pouch with opposed sides. A gripping element is adjacent a proximal end of the pouch, and a distal opening is vertically defined by the distal edges of the opposed inner faces. A plurality of elongated elastic elements are affixed at distal ends around the frame and at proximal ends to the pouch. The elastic elements are threaded through the pouch and are positioned to horizontally define the pouch opening. The pouch is movable between a stretched position wherein the elastic elements are biased in a proximal direction and a projecting position wherein the pouch is released. When released, the elastic elements urge the pouch in a distal direction toward the frame aperture and permit a projectile positioned in the pouch to be released proximally through the pouch opening and the frame aperture.

10 Claims, 5 Drawing Sheets

SLINGSHOT AND ARCHERY TRAINING DEVICE AND ASSOCIATED METHODS

FIELD OF THE INVENTION

The present invention is related to devices for projecting objects and methods of making and using same.

BACKGROUND

Slingshot-type apparatus are known for throwing birds to train retrieving dogs that include a rectangular frame through which the projectile is ejected. Slingshots with an arm brace and a strip-type sight are also known, as well as those having a pouch gripper feature.

SUMMARY

The present invention is directed to a device for projecting objects and methods of making and using such a device. The device of the present invention comprises a frame having an aperture therethrough and an inner portion grippable by a human hand. A projectile pouch comprises opposed sides, with each side having an inner face and an outer face. Gripping means are adjacent a proximal end of the pouch, and a distal opening is vertically defined by the distal edges of the opposed inner faces.

A plurality of elongated elastic elements are affixed at distal ends in spaced relation around the frame and at proximal ends to the pouch. Each of the elastic elements is threaded through the pouch along upper and lower edges thereof and are positioned to horizontally define the pouch opening.

The pouch is movable between a stretched position wherein the elastic elements are biased via the pouch gripping means in a proximal direction and a projecting position wherein the pouch gripping means is released. When released, the elastic elements act to urge the pouch in a distal direction toward the frame aperture and permit a projectile positioned in the pouch to be released in a proximal direction through the pouch opening and the frame aperture.

DETAILED DESCRIPTION OF PREFERRED EMBODIMENTS OF THE INVENTION

Figure 1:
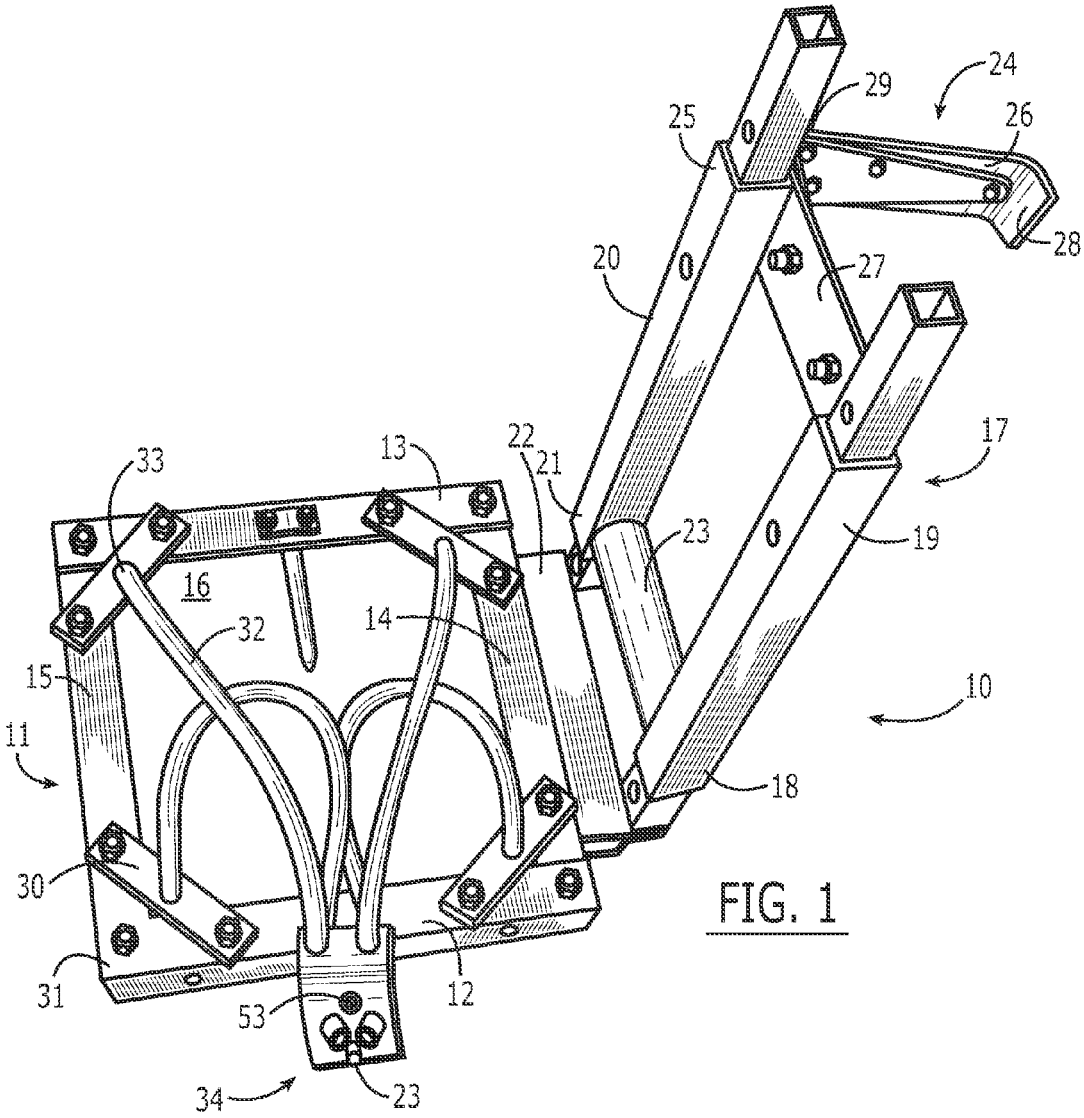
FIG. 1 is a perspective top-side view of the projecting device of the present invention.

Preferred embodiments of the device and methods of the present invention will now be described with reference to FIGS. 1-4.

The device 10 for projecting objects (FIG. 1) comprises a generally rectangular frame 11 formed by top 12, bottom 13, inner 14, and outer 15 sides defining an aperture 16 therethrough.

An elongated first support 17 is affixed at its distal end 18 in generally perpendicular fashion to the frame 11 and extends in a proximal direction therefrom. In the embodiment shown, the first support 17 comprises a pair of telescoping, parallel arms, one 19 adjacent the frame's top side 12 and one 20 adjacent the frame's bottom side 13. Distal ends 21 of the arms 19,20 are affixed to a connecting support 22 that is generally parallel to the frame 11. Extending between the arms 19,20 near the distal ends 21 is a gripping bar 23 dimensioned for being grasped by a human hand. The first support 17 is adapted and dimensioned for being positioned along an inside of a human arm.

An elongated second support 24 is affixed adjacent proximal ends 25 of the first support arms 19,20, and comprises a generally flat strip 26 having a width adapted to support an upper portion of a human arm. When in the usage position, the strip 26 is generally perpendicular to the first support 17 and to the frame 11. The second support 24 further comprises an affixing strip 27 that extends in bridging relation between the first support arms 19,20. An upwardly curved portion 28 of the flat strip 26 is adapted for retaining the device's position under the arm. The flat strip 26 is also movable via a hinge 29 to a storage position adjacent the bottom first support arm 20.

Four anchoring strips 30 are affixed to the frame 11, one strip 30 across an inside of a respective corner 31 of the frame 11. A plurality of elongated elastic elements, here, pieces of elastic tubing 32, are affixed at distal ends 33 in spaced relation around the frame 11 to a respective anchoring strip 30.

The device 10 further comprises a sighting device 52 that extends inward from a generally central location 53 of one side 13 of the frame 11, terminating in a pointed end 54 at a generally central location 55 in the aperture 16.

A pouch 34,34' (FIGS. 2A-2C) for holding a projectile comprises in a preferred embodiment a flexible rectangular element folded generally in half to form opposed sides 35, with each side having an inner face 36 and an outer face 37. A fold 38 comprises the proximal edge of the pouch, and opposed outer edges 39 form the distal edges, which vertically define a distal opening 40.

In a first embodiment (FIGS. 2A,2B) each of the elastic elements 32 is threaded through the pouch 34 so as to horizontally define the pouch opening 40. Specifically, each of the pouch's sides 35 has four holes therethrough comprising an upper pair 41,42 and a lower pair 43,44 generally adjacent respective upper 45 and lower 46 edges of the respective pouch side 35.

Each of the upper 41,42 and the lower 43,44 pairs comprises a distal hole 41,43 and a proximal 42,44 hole. A proximal portion 47 of each of the elastic elements 32 is disposed through a pair of holes 41-44 so that the proximal end 48 protrudes proximally from a respective proximal hole 42,44 and a distal end 49 of the proximal portion 47 protrudes distally from a respective distal hole 41,43. Thus a central portion 50 between the proximal end 48 and the distal end 49 of the proximal portion 47 is disposed between the inner faces 36 of the pouch sides 35. An internal pouch space 51 is thereby defined by the central portions 50 and sectors 52 of the inner faces 36 between the central portions 50.

In an alternate embodiment of a pouch 34' (FIG. 2C), believed at the time of filing to represent a preferred embodiment, each of the elastic elements 32 is threaded through the pouch 34' so as to horizontally define the pouch opening 40. Specifically, each of the pouch's sides 35 has two holes therethrough comprising an upper pair 41' and a lower pair 43' generally adjacent respective upper 45 and lower 46 edges of the respective pouch side 35.

Figure 2A:
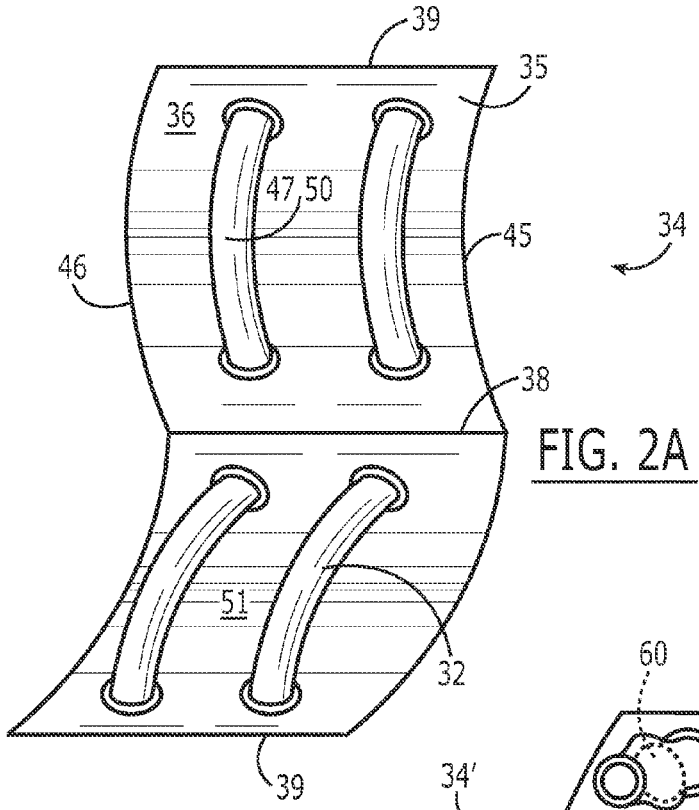
FIG. 2A is a detailed side view of the projectile pouch.
Figure 2C:
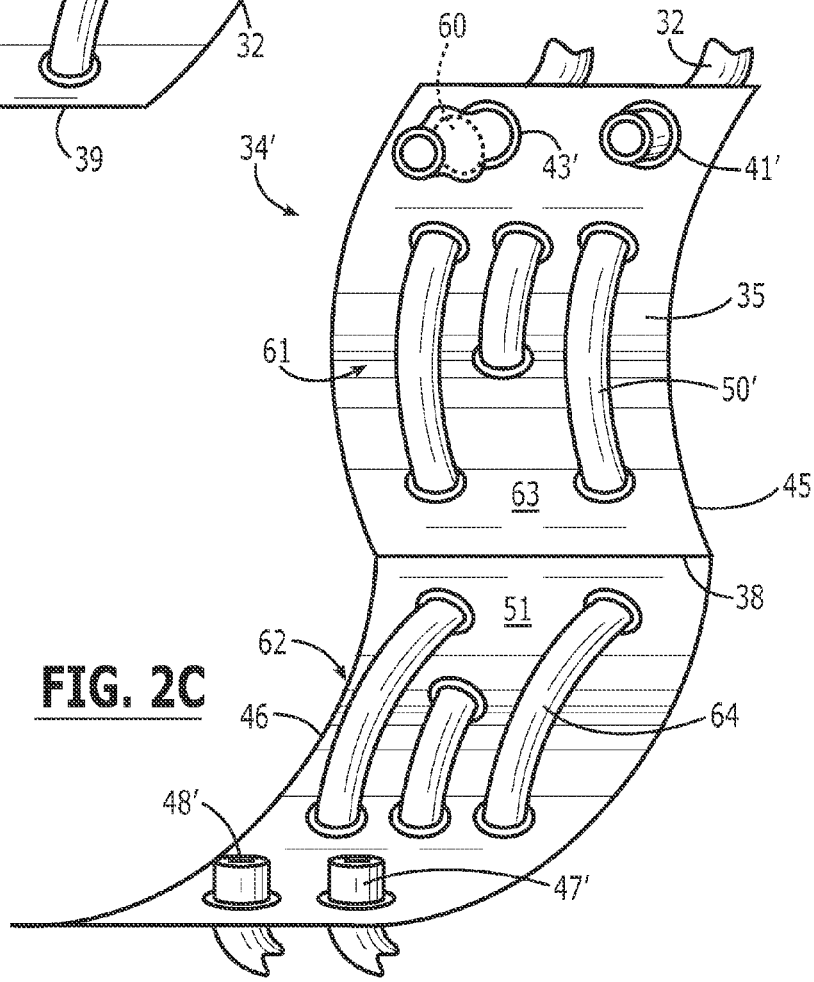
FIG. 2C is an interior view of an alternate embodiment of the projectile pouch.
Figure 2B:
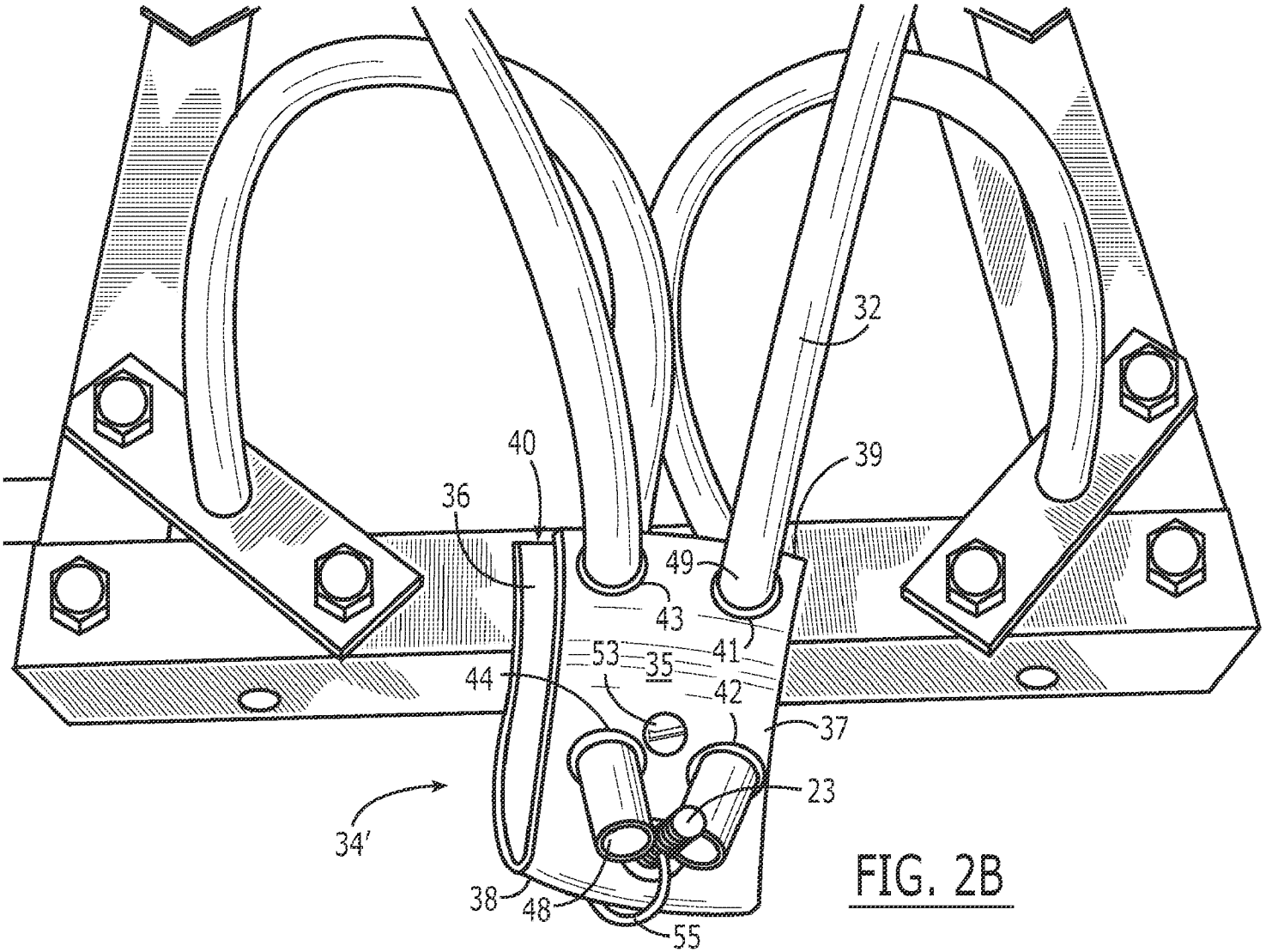
FIG. 2B is a detailed view of an interior of the pouch of FIG. 2A.
Figure 3:
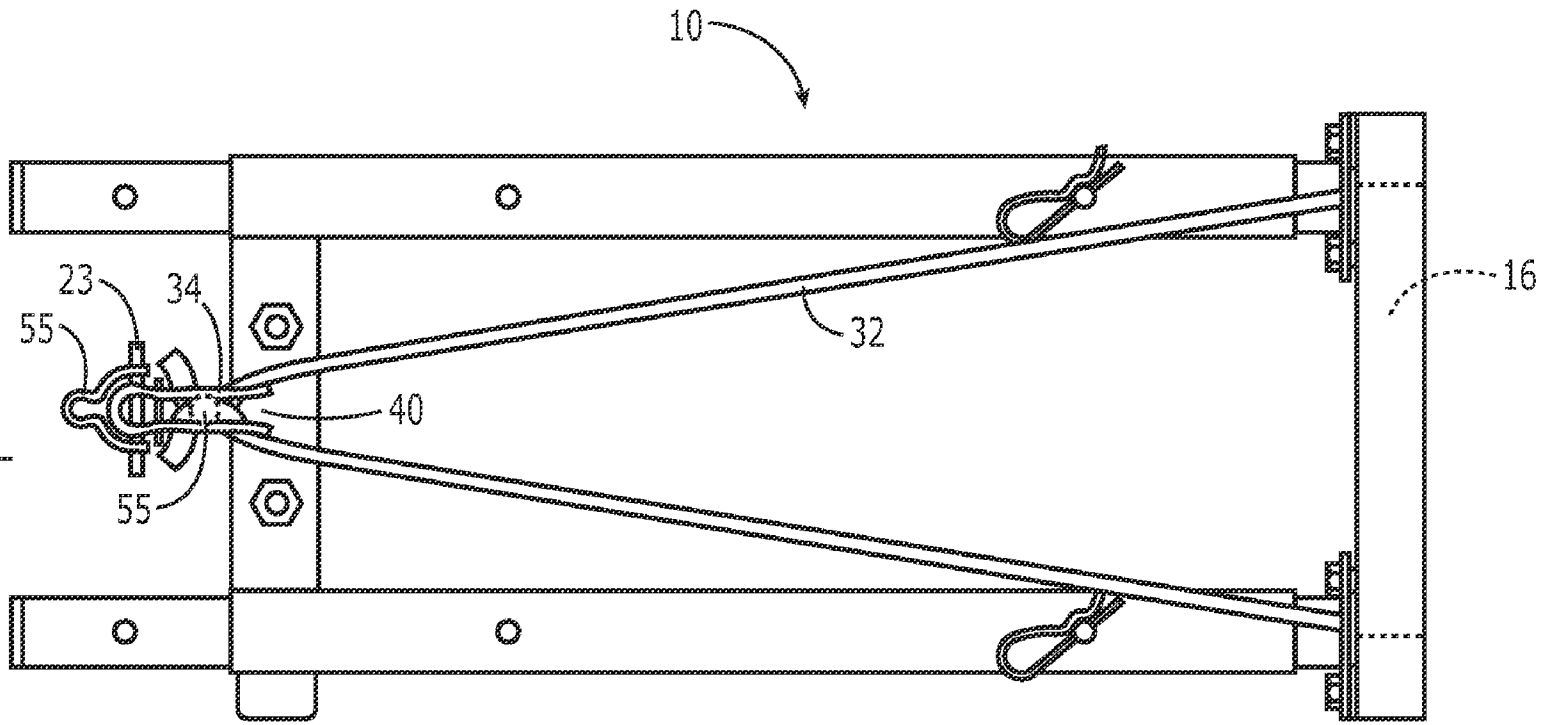
FIG. 3 is a schematic side view of the projecting device in the stretched position.
Figure 4:
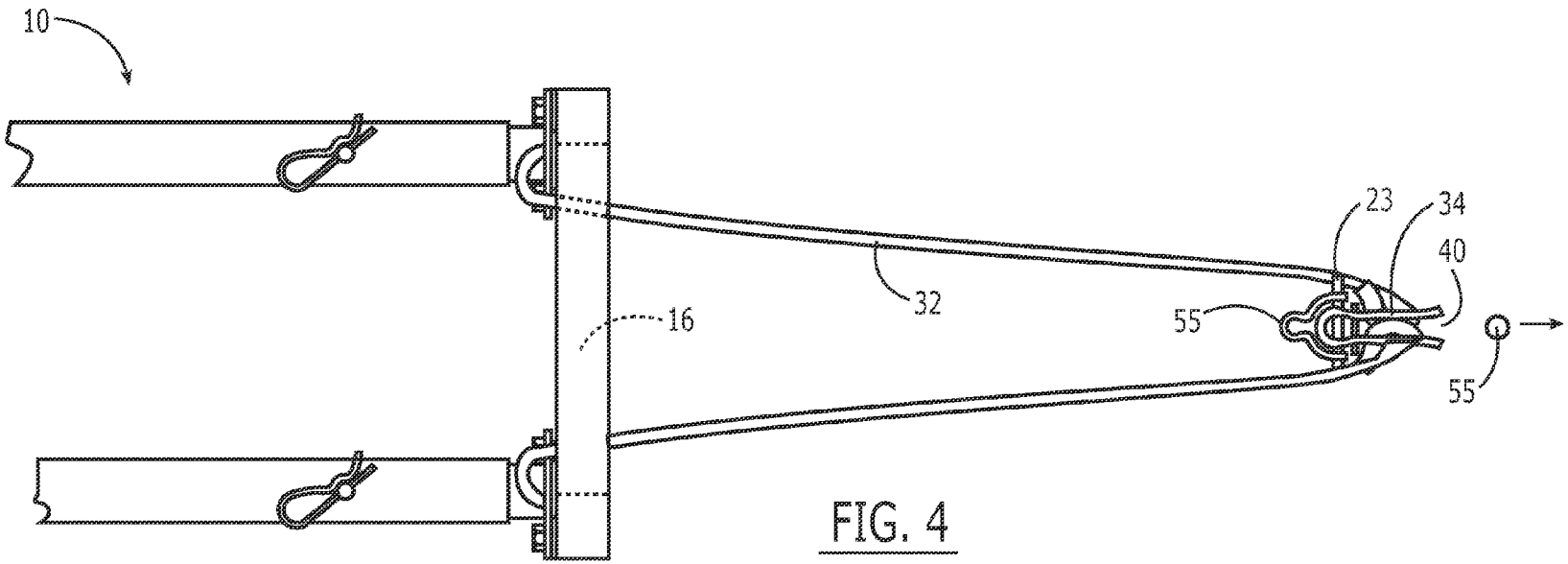
FIG. 4 is a schematic side view of the projecting device in the released position.

A proximal portion 47' of each of the elastic elements 32 is disposed through each of the holes 41',43' so that the proximal end 48' protrudes into the pouch internal space 51, and is retained there by a restraining element 60, such as a ball inserted within the tubing 32. In this embodiment the internal space 51 is further defined by spacing elements 61,62 positioned on the inner faces 36, each of the spacing elements 61,62 having a depression 63 adjacent the fold 38. Such spacing elements may comprise, for example, two U-shaped elements, or may comprise, as shown in FIG. 2B a plurality (here, six) of tubing pieces 64 threaded through additional holes through the pouch sides 35 so that a proximal portion 50' thereof extends between the inner faces 36 and so as to form the depression 63.

In a particular embodiment, a fastener 53 is positioned to join the pouch sides 35 together. Here the fastener 53 is disposed through the pouch sides 35 generally adjacent the proximal holes 42,44.

The pouch 34 further includes the gripping bar 23, which comprises in an exemplary embodiment an elongated generally cylindrical element disposed through and generally perpendicular to the pouch sides 35 adjacent the proximal fold 38. The gripping bar 23 preferably has a length that extends from each outer face 37 of the pouch 35, the length being sufficient to generally span a width of a human finger.

Associated with the gripping bar 23 is a metal loop 55 extending in a proximal direction from the bar 23.

The pouch 35 is movable between a stretched position (FIG. 3) wherein the elastic elements 32 are biased via the pouch gripping bar 23 in a proximal direction and a projecting position (FIG. 4) wherein the pouch gripping bar 23 is released. When released, the elastic elements 32 act to urge the pouch 34 in a distal direction toward the aperture 16 and permit a projectile 55 positioned in the pouch 34 to be released in a proximal direction through the pouch opening 40 and the frame aperture 16.

What is claimed is:

1. A device for projecting an object comprising:

a frame having an aperture therethrough and an inner portion grippable by a human hand;

a projectile pouch comprising opposed sides, each side having an inner face and an outer face, gripping means adjacent a proximal end, and a distal opening vertically defined by distal edges of the opposed inner faces, wherein the gripping means comprises an elongated generally cylindrical element disposed through and generally perpendicular to the pouch sides adjacent the proximal edge and having a length extending from each outer face of the pouch sufficient to generally span a width of a human finger;

a plurality of elongated elastic elements affixed at distal ends in spaced relation around the frame and at proximal ends to the pouch, each of the elastic elements threaded through the pouch along upper and lower edges thereof and positioned to horizontally define the pouch opening;

an elongated first support affixed at a distal end generally perpendicular to the frame and extending in a proximal direction therefrom, the first support adapted for being positioned along an inside of a human arm; and an elongated second support movably affixed at an outer end generally perpendicular to the first support and to the frame, the second support adapted for being positioned under a human arm;

wherein the pouch is movable between a stretched position wherein the elastic elements are biased via the pouch gripping means in a proximal direction and a projecting position wherein the pouch gripping means is released, the elastic elements urging the pouch in a distal direction toward the frame aperture and permitting a projectile positioned in the pouch to be released in a proximal direction through the pouch opening and the frame aperture.

2. The projecting device recited in claim 1, wherein the elastic elements comprise elastic tubing.

3. The projecting device recited in claim 1, wherein the pouch comprises a flexible rectangular element folded generally in half to form the opposed sides, a fold thereof comprising the proximal edge and opposed outer edges thereof forming the distal edges.

4. A device for projecting an object comprising:

a generally rectangular frame having an aperture therethrough and an inner portion grippable by a human hand;

a projectile pouch comprising opposed sides, each side having an inner face and an outer face, gripping means adjacent a proximal end, and a distal opening vertically defined by distal edges of the opposed inner faces;

a plurality of elongated elastic elements affixed at distal ends in spaced relation around the frame and at proximal ends to the pouch, each of the elastic elements threaded through the pouch along upper and lower edges thereof and positioned to horizontally define the pouch opening, the elastic elements comprising four pieces of elastic tubing, each piece of elastic tubing affixed at the distal end adjacent a respective corner of the frame; and an elongated first support affixed at a distal end generally perpendicular to the frame and extending in a proximal direction therefrom, the first support adapted for being positioned along an inside of a human arm;

wherein the pouch is movable between a stretched position wherein the elastic elements are biased via the pouch gripping means in a proximal direction and a projecting position wherein the pouch gripping means is released, the elastic elements urging the pouch in a distal direction toward the frame aperture and permitting a projectile positioned in the pouch to be released in a proximal direction through the pouch opening and the frame aperture.

5. The projecting device recited in claim 4, further comprising four anchoring strips, one anchoring strip affixed across an inside of a respective corner of the frame, and wherein the distal end of each elastic tubing piece is affixed to a respective anchoring strip.

6. The projecting device recited in claim 4, further comprising a sighting device extending inward from a generally central location of one side of the frame, terminating in a pointed end at a generally central location in the aperture.

7. A device for projecting an object comprising:

a frame having an aperture therethrough and an inner portion grippable by a human hand;

a projectile pouch comprising a flexible rectangular element folded generally in half to form opposed sides, a fold thereof comprising a proximal edge and opposed outer edges thereof forming distal edges, each side having an inner face and an outer face, the pouch further comprising gripping means adjacent a proximal end, and a distal opening vertically defined by the distal edges of the opposed inner faces;

a plurality of elongated elastic elements affixed at distal ends in spaced relation around the frame and at proximal ends to the pouch, each of the elastic elements threaded through the pouch along upper and lower edges thereof and positioned to horizontally define the pouch opening;

an elongated first support affixed at a distal end generally perpendicular to the frame and extending in a proximal direction therefrom, the first support adapted for being positioned along an inside of a human arm;

an elongated second support affixed at an outer end generally perpendicular to the first support and to the frame, the second support adapted for being positioned under a human arm;

wherein the pouch is movable between a stretched position wherein the elastic elements are biased via the pouch gripping means in a proximal direction and a projecting position wherein the pouch gripping means is released, the elastic elements urging the pouch in a distal direction toward the frame aperture and permitting a projectile positioned in the pouch to be released in a proximal direction through the pouch opening and the frame aperture, and wherein each of the pouch sides has four holes therethrough comprising an upper pair and a lower pair generally adjacent respective upper and lower edges of the respective pouch side, each of the upper and the lower pairs comprising a distal hole and a proximal hole, and wherein a proximal portion of each of the elastic elements is disposed through a pair of holes so that the proximal end protrudes proximally from the proximal hole and a distal end of the proximal portion protrudes distally from the distal hole, a central portion between the proximal end and the distal end of the proximal portion thereby disposed between the inner faces of the pouch sides, an internal pouch space defined by the central portions and sectors of the inner faces between the central portions.

8. The projecting device recited in claim 7, further comprising a fastener positioned to join the pouch sides together, the fastener disposed through the pouch sides generally adjacent the proximal holes.

9. A device for projecting an object comprising:

a frame having an aperture therethrough and an inner portion grippable by a human hand;

a projectile pouch comprising a flexible rectangular element folded generally in half to form opposed sides, a fold thereof comprising a proximal edge and opposed outer edges thereof forming distal edges, each side having an inner face and an outer face, the pouch further comprising gripping means adjacent a proximal end, and a distal opening vertically defined by the distal edges of the opposed inner faces;

a plurality of elongated elastic elements affixed at distal ends in spaced relation around the frame and at proximal ends to the pouch, each of the elastic elements threaded through the pouch along upper and lower edges thereof and positioned to horizontally define the pouch opening;

an elongated first support affixed at a distal end generally perpendicular to the frame and extending in a proximal direction therefrom, the first support adapted for being positioned along an inside of a human arm; and an elongated second support affixed at an outer end generally perpendicular to the first support and to the frame, the second support adapted for being positioned under a human arm;

wherein the pouch is movable between a stretched position wherein the elastic elements are biased via the pouch gripping means in a proximal direction and a projecting position wherein the pouch gripping means is released, the elastic elements urging the pouch in a distal direction toward the frame aperture and permitting a projectile positioned in the pouch to be released in a proximal direction through the pouch opening and the frame aperture, and wherein each of the pouch sides has two holes therethrough comprising an upper hole and a lower hole generally adjacent respective upper and lower edges of the respective pouch side, and wherein a proximal portion of each of the elastic elements is disposed through a hole so that the proximal end protrudes between inner faces of the pouch sides, an internal pouch space defined by the proximal portions and sectors of the inner faces between the proximal portions.

10. The projecting device recited in claim 9, wherein the pouch further comprises a spacing element positioned within the internal pouch space, the spacing element having a generally central depression adapted for holding a projectile therein.

* * * * *